US009088853B2

(12) United States Patent
Angst et al.

(10) Patent No.: US 9,088,853 B2
(45) Date of Patent: Jul. 21, 2015

(54) RECEIVER SYSTEM FOR A HEARING INSTRUMENT

(75) Inventors: Jan Angst, Hirzel (CH); Erdal Karamuk, Maennedorf (CH); Hilmar Meier, Zurich (CH); Roland Hug, Hinwil (CH); Andi Vonlanthen, Oberrohrdorf (CH)

(73) Assignee: Phonak AG, Stäfa (CH)

( * ) Notice: Subject to any disclaimer, the term of this patent is extended or adjusted under 35 U.S.C. 154(b) by 84 days.

(21) Appl. No.: 13/813,851

(22) PCT Filed: Aug. 3, 2010

(86) PCT No.: PCT/EP2010/061282

§ 371 (c)(1),
(2), (4) Date: Apr. 4, 2013

(87) PCT Pub. No.: WO2010/116006

PCT Pub. Date: Oct. 14, 2010

(65) Prior Publication Data

US 2013/0182877 A1 Jul. 18, 2013

(51) Int. Cl.
*H04R 25/00* (2006.01)
*H04R 1/22* (2006.01)

(52) U.S. Cl.
CPC ..... *H04R 25/652* (2013.01); *H04R 1/227* (2013.01); *H04R 25/48* (2013.01); *H04R 25/604* (2013.01); *H04R 25/656* (2013.01); *H04R 25/658* (2013.01)

(58) Field of Classification Search
CPC ..... H04R 2225/023
USPC ..... 381/328, 322
See application file for complete search history.

(56) References Cited

U.S. PATENT DOCUMENTS

| | | | | |
|---|---|---|---|---|
| 4,629,833 | A | 12/1986 | Kern et al. | |
| 5,201,007 | A * | 4/1993 | Ward et al. | 381/328 |
| 6,212,283 | B1 * | 4/2001 | Fletcher et al. | 381/313 |
| 7,720,242 | B2 | 5/2010 | Anderson et al. | |
| 8,391,534 | B2 * | 3/2013 | Ambrose et al. | 381/380 |
| 2008/0137892 | A1 * | 6/2008 | Shennib et al. | 381/328 |

FOREIGN PATENT DOCUMENTS

| | | | |
|---|---|---|---|
| EP | 1 871 141 | A2 | 12/2007 |
| EP | 2 131 612 | A2 | 12/2009 |
| GB | 2 018 089 | A | 10/1979 |
| WO | 2006/122010 | A1 | 11/2006 |

* cited by examiner

*Primary Examiner* — Ahmad F Matar
*Assistant Examiner* — Norman Yu
(74) *Attorney, Agent, or Firm* — Roberts Mlotkowski Safran & Cole, P.C.; David S. Safran

(57) ABSTRACT

A hearing instrument receiver system for operation in an ear canal of a user for converting audio signals into sound, comprising a lateral receiver, a medial receiver and a flexible joint assembly connecting the medial end of the lateral receiver and the lateral end of the medial receiver in such a manner that the lateral receiver and the medial receiver are pivotable relative to each other in order to follow the shape of the ear canal.

24 Claims, 3 Drawing Sheets

RECEIVER SYSTEM FOR A HEARING INSTRUMENT

BACKGROUND OF THE INVENTION

1. Field of the Invention

The invention relates to a receiver system of a hearing instrument for operation in the ear canal of a user.

2. Description of Related Art

Typically, receivers (i.e., loudspeakers) of hearing instruments have a geometry (cross-section and length) which makes it difficult to place the receiver deep in the ear canal. The size of the receiver depends on the degree of hearing loss: the more profound the hearing loss of the user is, the larger the receiver has to be in order to generate the required sound pressure levels. In particular, the sharp bend of the ear canal makes it difficult to place receivers deep in the ear canal: even the smallest available receivers can be hardly placed in the region of the sharp bend or beyond it.

A simple reduction of the receiver size would result in a corresponding reduction of acoustic output performance which would not be acceptable. When seeking to maintain the acoustic performance, a smaller cross-section of the receiver would require an increased length which, in turn, would result in a low fit rate due to the sharp bend in the ear canal.

U.S. Pat. No. 4,629,833 relates to a BTE (behind-the-ear) hearing aid comprising two identical receivers, wherein each receiver has a separate sound output channel comprising acoustic impedance elements which serve to adjust the transfer function separately for each receiver. The two sound output channels merge into a common sound channel which is connected to a sound tube extending into the user's ear canal.

European Patent Application EP 1 871 141 A2 relates to a hearing aid receiver system comprising high frequency receiver and a low frequency receiver having a tube connected to its output port, wherein the high frequency receiver is positioned within the tube in a manner that sound emanating from the output port of the low frequency receiver is able to flow around the high frequency receiver. The low frequency receiver, the high frequency receiver and the tube are housed within a housing which is sized to fit within an average person's ear canal.

SUMMARY OF THE INVENTION

It is an object of the invention to provide for a hearing instrument receiver system for operation in the ear canal which allows for high fit rate in the ear canal, i.e. which can be deeply inserted into the ear canal, while nevertheless providing for sufficient acoustic performance.

According to the invention, this object is achieved by a receiver system as described herein below.

The invention is beneficial in that, by providing for a cascade arrangement of a lateral receiver module and a medial receiver module which are connected by a flexible joint assembly in a manner that the receiver modules are pivotable relative to each other in order to follow the shape of the ear canal, deep insertion of the receiver system into the ear canal, in particular also into and beyond the region of the sharp bend, is enabled, without compromising acoustic performance too much. In particular, due to the provision of the flexible joint assembly, the necessary increase in overall length of the receiver system due to the reduced cross-section of the receiver system, as compared to a conventional receiver system, does not prevent the receiver system from being inserted deeply into the ear canal.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
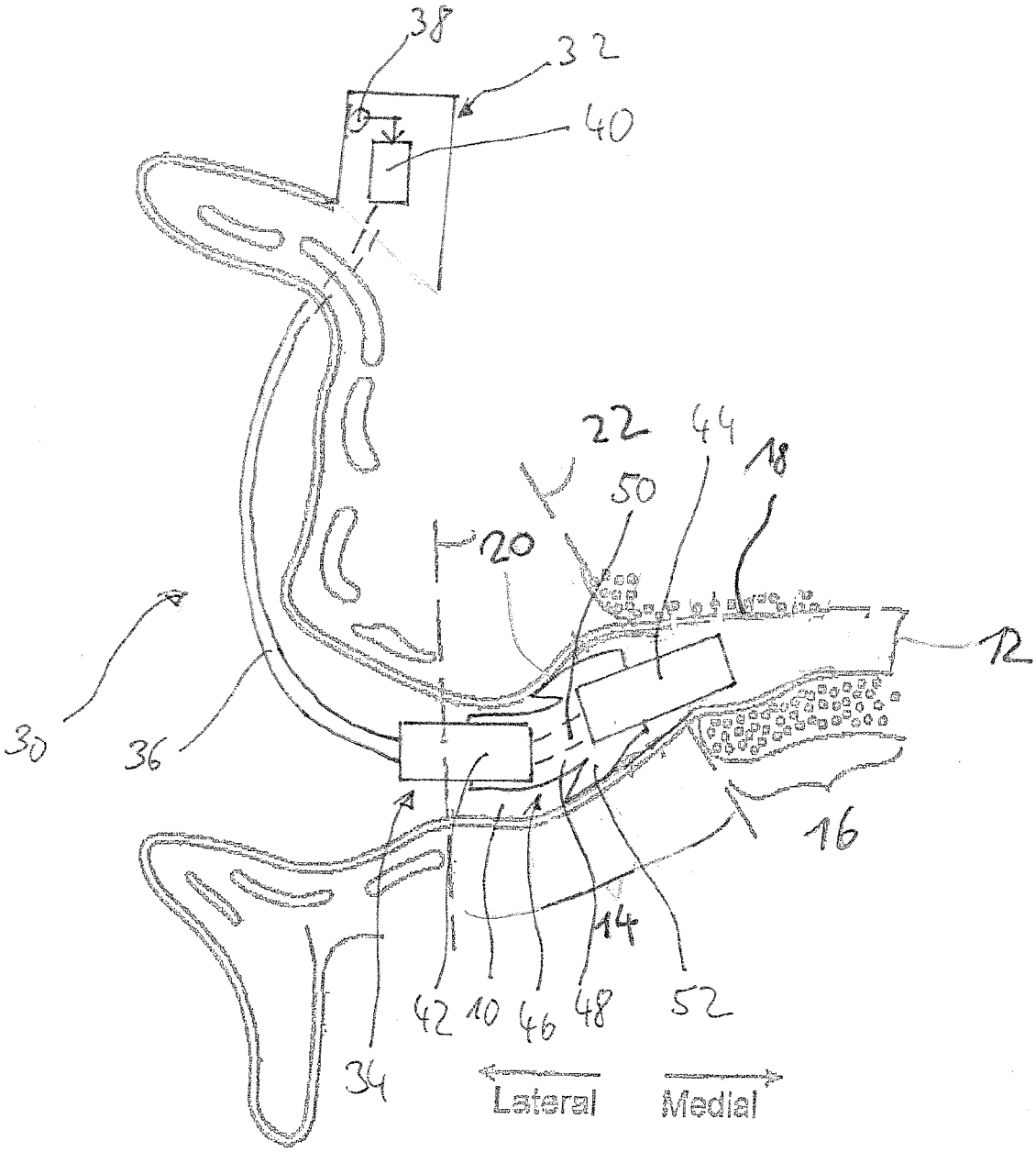
FIG. 1 is a lateral view of an example of a hearing instrument including a receiver system according to the invention when positioned in the ear canal.
Figure 2:
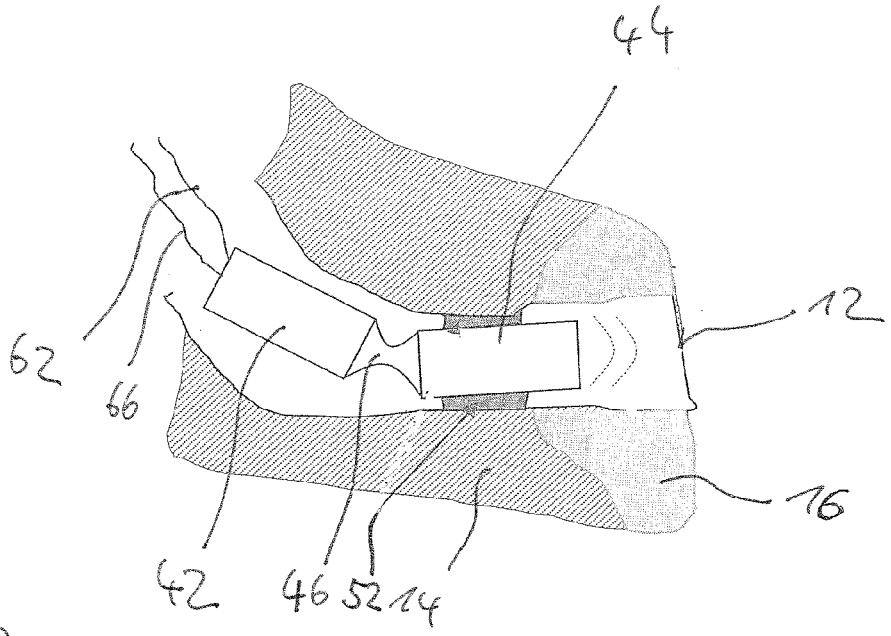
FIG. 2 is a view like FIG. 1, wherein an example of a receiver system according to the invention is shown when positioned within the ear canal.

As shown in FIG. 1, the ear canal 10 comprises, in its lateral part (i.e., away from the tympanic membrane 12) a cartilaginous region 14, which is relatively soft due to the underlying cartilaginous tissue and, in its medial (towards the tympanic membrane 12) part a bony region 16, which is relatively rigid due to the underlying bony tissue. The skin 18 in the bony region 16 is relatively thin and more sensitive to touch or pressure than the skin 20 in the cartilaginous region 14. There is a characteristic bend in the ear canal 10, which roughly occurs at the bony-cartilaginous junction 22 separating the regions 14 and 16.

In FIG. 1 a BTE (behind-the-ear) hearing aid 30 is shown which comprises a module 32 which is to be worn behind the ear and a receiver system 34 which is to be worn in the ear canal 10 and which is connected electrically to the module 32 via a cable 36. As usual, the module 32 includes a microphone arrangement 38 for capturing audio signals from ambient sound and an audio signal processing unit 40 for processing the captured audio signals, which processed audio signals are amplified and supplied via the cable 36 to the receiver system 34 which converts the audio signals into sound impinging on the tympanic membrane 12.

The receiver system 34 comprises a lateral receiver 42, a medial receiver 44 and a flexible joint assembly 46 which connects the medial end of the lateral receiver 42 and the lateral end of the medial receiver 44 in such a manner that the lateral receiver 42 and the medial receiver 44 are pivotable relative to each other in order to follow the shape of the ear canal 10 when being inserted into the ear canal 10. The joint assembly 46 is made of a sufficiently elastic/flexible material, such as silicone or molded thermoplastic elastomers (TPE). The joint assembly 46 is formed as an elastic sleeve around the medial end of the lateral receiver 42 and the lateral end of the medial receiver 44 and has a pivotal portion 48 between the medial end of the lateral receiver 42 and the lateral end of the medial receiver 44. The pivotal portion 48 may comprise a lumen 50 extending between the lateral receiver 42 and the medial receiver 44.

The flexible joint assembly 46 also comprises an elastic retention element 52 for holding, by contacting the wall/skin 20 of the ear canal 10, at least one of the receivers 42, 44 at a desired position in the ear canal 10 (in the example of FIG. 1, the retention element 52 is located close to the medial receiver 44). The retention element 52 preferably is dome-shaped, and it may surround a portion, typically the lateral end, of the medial receiver 44; alternatively, it may form part of the pivotal portion 48 of the joint assembly 46. In the latter case, the retention element 52 is designed as a portion of the joint assembly 46 having a larger cross-section than the remainder of the joint assembly 46. Preferably, the medial receiver 44 is to be inserted at least in part into the bony part 16 of the ear canal 10, with the retention element 52 being designed such that the medial receiver 44 does not touch the wall 18 of the bony part 16 of the ear canal 10. Preferably, the retention element 52 is designed such that it does not touch the wall 18 of the bony part 16 of the ear canal 10.

Typically, the receiver system 34 is designed such that the lateral receiver 42 and the medial receiver 44 are located completely in the ear canal 10.

Figure 3:
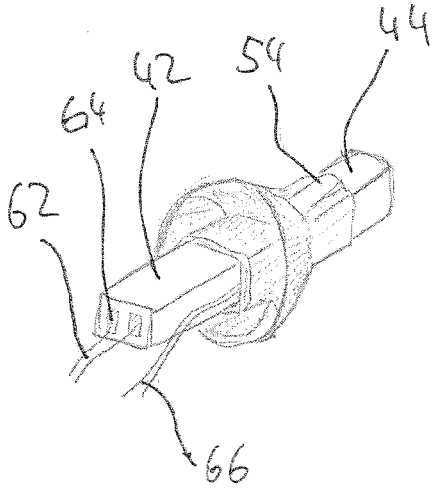
FIG. 3 is a perspective view of an example of a receiver system according to the invention prior to being inserted into the ear canal.
Figure 4:
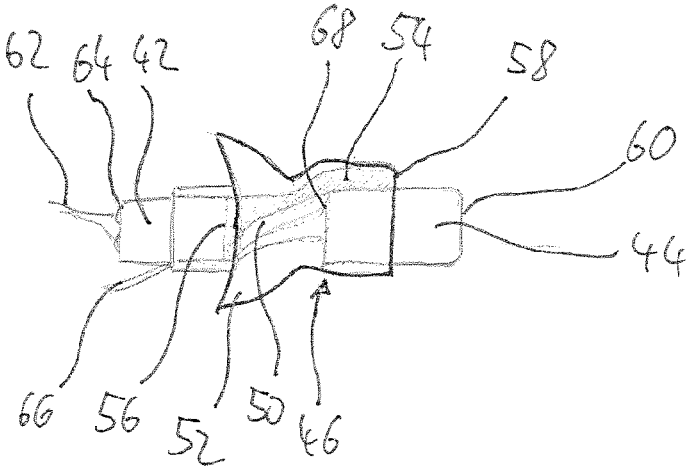
FIG. 4 is a lateral view of the receiver system of FIG. 3.

According to the embodiment shown in FIGS. 3 and 4, the joint assembly 46 comprises a sound channel 54 extending from the sound outlet 56 of the lateral receiver 42 to a sound outlet opening 58 at the medial end of the joint assembly 46 in order to cause sound emanating from the sound outlet 56 of the lateral receiver 42 to bypass the medial receiver 44. The sound outlet of the medial receiver 44 is indicated at 60 in FIG. 4. In the example shown in FIGS. 3 and 4, the sound outlet opening 58 of the sound channel 54 is located at the periphery of the medial receiver 44 approximately in a middle portion thereof, i.e., the sound outlet opening 58 is axially spaced-apart from the sound outlet 60 of the medial module 44 in the lateral direction.

The lateral receiver 42, the medial receiver 44 and the joint assembly 46 may be designed in a manner that the back volume of the lateral receiver 42 and the back volume of the medial receiver 44 are acoustically connected and/or that the front volume of the lateral receiver 42 and the front volume of the medial receiver 44 are acoustically connected.

Figure 5:
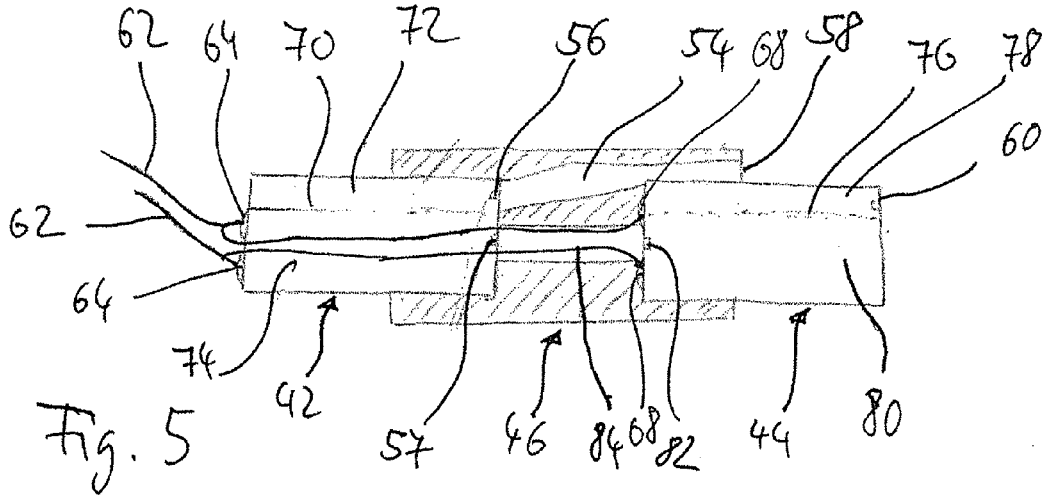
FIG. 5 is cross-sectional view of an example of a receiver system according to the invention having a shared back volume.

An example of the receiver system of FIG. 4 having a shared back volume is shown in FIG. 5. The lateral receiver 42 comprises a speaker membrane 70 diving the volume of the lateral receiver 42 into a front volume 72 and a back volume 74, each having a sound outlet 56 and 57, respectively, with the front volume sound outlet 56 communicating with the sound channel 54 of the joint assembly 46 having the sound outlet opening 58 and bypassing the medial receiver 44. The medial receiver 44 comprises a speaker membrane 76 diving the volume of the medial receiver 44 into a front volume 78 and a back volume 80, each having a sound outlet 60 and 82, respectively, with the back volume sound outlet 82 communicating with a sound channel 84 of the joint assembly 46 which, in turn, communicates with the back volume sound outlet 57 of the lateral receiver 42. Thus, the channel 84 acts to connect the two back volumes 74 and 80, thereby creating a shared back volume configuration of the receivers 42 and 44. As indicated in FIG. 4, the front volume sound outlet 60 is separate from the sound outlet 58 of the joint assembly 46.

Figure 6:
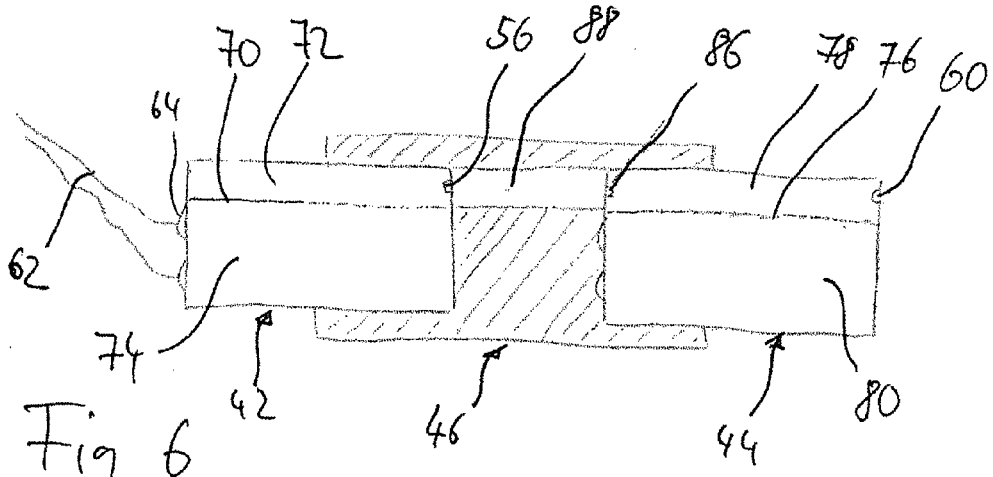
FIGS. 6 and 7 are cross-sectional views of two different examples of a receiver system according to the invention having a shared front volume.
Figure 7:
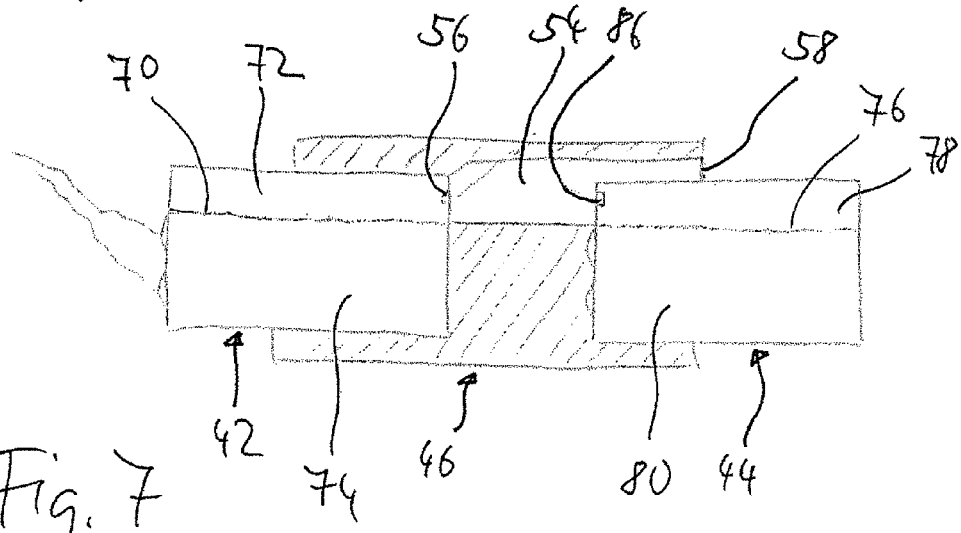

Examples of a receiver system having a shared back volume are shown in FIGS. 6 and 7. According to the example of FIG. 6, the back volumes 74 and 80 are closed, while the front volume 78 of the medial receiver 44 comprises a laterally oriented second sound outlet 86 in addition to the medially oriented sound outlet 60, with the second sound outlet 86 communicating with a sound channel 88 of the joint assembly 46, which, in turn, communicates with the front volume outlet 56 of the lateral receiver 42. In contrast to the sound channel 54 of the embodiment of FIG. 5, the sound channel 88 does not have a sound outlet 58. The sound channel 88 thus acts to connects the two front volumes 72 and 78, thereby creating a shared front volume configuration of the receivers 42 and 44, with a single sound outlet 60.

In the example shown in FIG. 7, the back volumes 74 and 80 are closed like in the example of FIG. 6, while the sound channel 54 communicates both with the front volume sound outlet 56 of the lateral receiver 42 and with the laterally oriented front volume sound outlet 86 of the medial receiver 44 and, as in the example of FIG. 5, has sound outlet 58. In contrast to the examples of FIGS. 5 and 6, the front volume 78 of the medial receiver 44 does not have a medially oriented sound outlet 60.

As indicated in FIGS. 3 and 4, litz wires 62 are soldered to contacts 64 at the lateral end of the lateral receiver 42 in order to connect the lateral receiver 42 to the BTE module 32. Similarly, litz wires 66 are soldered to contacts 68 at the lateral end of the medial receiver 44 in order to connect the medial receiver 44 to the BTE module 32. To this end, the cable 36 may be designed as a flexible tube having a lumen through which the litz wires 62, 66 extend to the BTE module 32. The litz wires 66 extend through the lateral end of the joint assembly 46 into and through the lumen 50 to the contacts 68.

Preferably, the receivers 42, 44 are of the same type (e.g., the resonance frequency is substantially the same) in order to emit sound in the same frequency range, i.e., the receivers 42, 44 have essentially the same frequency response.

The lateral receiver 42 and the medial receiver 44 may be electrically connected in parallel, with substantially the same audio signal being supplied to both receivers 42, 44. Alternatively, the lateral receiver 42 and the medial receiver 44 may be electrically connected in series.

According to a preferred embodiment, the lateral receiver 42 and the medial receiver 44 are operated in an anti-parallel manner so as to mutually compensate the vibration of the receivers 42, 44 and/or magnetic or electrical stray fields (i.e. there is a phase shift of 180 degrees between the input signals to the lateral receiver 42 and the input signals to the medial receiver 44). To this end, the receivers 42, 44 have to be identical.

Very small and thin receivers which may be used with the invention are available, for example, as model 41xx from Sonion, Denmark.

The receiver system 34 is designed for insertion into the ear canal 10 without using a tool. When inserting the receiver system 34 into the ear canal 10, the lateral receiver 42 is seized and is advanced towards the ear canal in order to push the medial receiver 44 into the ear canal 10, with the medial receiver 44 being guided within the ear canal 10 by movement of the retention element 52 along the wall 20 of the ear canal 10. The pushing force is transmitted from the lateral receiver 42 via the joint assembly 46 to the medial receiver 44. The receiver systems of the invention may be used not only as the external receiver of a BTE hearing aid, but rather it also may form the medial end of a ITE (in-the-ear) or CIC (completely-in-the-canal) hearing aid. In this case, not only the receiver system 34 but also the remainder of the hearing aid will be located in the ear canal.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A hearing instrument receiver system for operation in an ear canal of a user for converting audio signals into sound, comprising a lateral receiver, a medial receiver and a flexible joint assembly of an elastically flexible material connecting a medial end of the lateral receiver and a lateral end of the medial receiver in such a manner that the lateral receiver and the medial receiver are pivotable relative to each other in order to follow a shape of the ear canal, wherein the joint assembly comprises a sound channel extending from a sound outlet of the lateral receiver towards a medial end of the joint assembly for causing sound emanating from the sound outlet of the lateral receiver to by-pass the medial receiver.

2. The system of claim 1, wherein the receiver system is designed such that the lateral receiver and the medial receiver are to be located completely in the ear canal.

3. The system of claim 1, wherein the flexible joint assembly is made of silicone or molded thermoplastic elastomers (TPE).

4. The system of claim 1, wherein the medial receiver is adapted for being inserted at least in part into a bony part of the ear canal.

5. The system of claim 1, wherein the receiver system comprises an elastic retention element for holding, by contacting a wall of the ear canal, at least one of the lateral receiver and the medial receiver at a desired position in the ear canal.

6. The system of claim 5, wherein the retention element is adapted for preventing the medial receiver from touching a wall of the bony part of the ear canal when inserted in the ear canal.

7. The system of claim 6, wherein the retention element is adapted for prevent it touching the bony part of the ear canal when the receiver system has been inserted into the ear canal.

8. The system of claim 5, wherein the retention element surrounds a portion of the medial receiver.

9. The system of claim 5, wherein the retention element is dome-shaped.

10. The system of claim 5, wherein the retention element is formed as a portion of the flexible joint assembly, the retention element having a larger cross-section than a remainder of the joint assembly.

11. The system of claim 1, wherein the flexible joint assembly comprises an elastic sleeve around the medial end of the lateral receiver and the lateral end of the medial receiver, the sleeve having a pivotal portion extending between the medial end of the lateral receiver and the lateral end of the medial receiver.

12. The system of claim 11, wherein the retention element forms part of the pivotal portion of the joint assembly.

13. The system of claim 1, wherein the joint assembly comprises a lumen, with Litz wires extending from the medial receiver through said lumen towards a lateral end of the joint assembly.

14. A hearing instrument receiver system for operation in an ear canal of a user for converting audio signals into sound, comprising a lateral receiver, a medial receiver and a flexible joint assembly of an elastically flexible material connecting a medial end of the lateral receiver and a lateral end of the medial receiver in such a manner that the lateral receiver and the medial receiver are pivotable relative to each other in order to follow a shape of the ear canal, wherein the lateral receiver and the medial receiver are of a same type in order to emit sound in a same frequency range, and wherein the lateral receiver and the medial receiver are identical, and wherein the receiver system is adapted to operate the lateral receiver and the medial receiver in an anti-parallel manner so as to mutually compensate a vibration of the receivers and/or magnet or electrical stray fields.

15. The system of claim 1, wherein the lateral receiver, the medial receiver and the joint assembly are adapted in manner causing at least one of a back volume of the lateral receiver and a back volume of the medial receiver to be acoustically connected and a front volume of the lateral receiver and a front volume of the medial receiver to be acoustically connected.

16. The system of claim 15, wherein the joint assembly comprises a sound channel for acoustically connecting a sound outlet of the back volume of the lateral receiver and a sound outlet of the back volume of the medial receiver.

17. The system of claim 15, wherein the joint assembly comprises a sound channel for acoustically connecting a sound outlet of a front volume of the lateral receiver and a sound outlet of a front volume of the medial receiver.

18. The system of claim 17, wherein the sound channel for acoustically connecting the sound outlet of the front volume of the lateral receiver and the sound outlet of the front volume of the medial receiver comprises a sound outlet.

19. The system of claim 1, further comprising connecting means for being electrically and mechanically connected, at its lateral end, to a BTE hearing aid.

20. The system of claim 19, wherein the connecting means comprises a flexible tube having a lumen for Litz wires to the receivers.

21. The system of claim 1, wherein receiver system forms a medial end of at least one an ITE and a CIC hearing aid.

22. A hearing instrument for converting audio signals into sound, comprising:

a module to be worn behind a user's ear, and a receiver system to be worn in a user's ear canal, the receiver system being connect to the module by a cable, wherein the receiver system comprises:

a lateral receiver, a medial receiver and a flexible joint assembly of an elastically flexible material connecting a medial end of the lateral receiver and a lateral end of the medial receiver in such a manner that the lateral receiver and the medial receiver are pivotable relative to each other in order to follow a shape of the ear canal, and wherein the lateral receiver and the medial receiver are electrically connected in parallel, with substantially a same audio signal being supplied to the lateral receiver and the medial receiver.

23. The hearing instrument of claim 22, wherein the hearing instrument is a CIC or ITE hearing aid.

24. The hearing instrument of claim 22, wherein the hearing instrument is a BTE hearing aid.

* * * * *